United States Patent [19]

Thaler et al.

[11] Patent Number: 4,473,086

[45] Date of Patent: Sep. 25, 1984

[54] HAIR CURLING DEVICE HAVING RETRACTABLE TEETH AND LOCKING MEANS THEREFOR

[75] Inventors: Arnold Thaler, Plantation; David Friedson, Miami, both of Fla.; Lai Kin, Kowloon, Hong Kong

[73] Assignee: Save-Way Industries, Inc., Hialeah, Fla.

[21] Appl. No.: 451,847

[22] Filed: Dec. 21, 1982

Related U.S. Application Data

[63] Continuation-in-part of Ser. No. 350,185, Feb. 19, 1982.

[51] Int. Cl.[3] ..... A45D 2/24

[52] U.S. Cl. ..... 132/37 R; 219/222

[58] Field of Search ..... 132/37 R, 33, 40, 42, 132/11 R, 9, 159, 123, 34 R, 37; 219/222, 225

[56] References Cited

U.S. PATENT DOCUMENTS

| | | | |
|---|---|---|---|
| 190,602 | 5/1877 | Maggi . | |
| 411,028 | 9/1889 | Heysinger . | |
| 946,622 | 1/1910 | Thurman | 132/159 X |
| 2,137,828 | 11/1938 | Arpin et al. . | |
| 2,175,344 | 10/1939 | Friedman | 132/159 X |
| 2,244,068 | 6/1941 | Kay . | |
| 2,245,055 | 6/1941 | Schlicker . | |
| 2,526,577 | 10/1950 | Renstrom et al. . | |
| 2,803,256 | 8/1957 | Lerner . | |
| 3,140,719 | 7/1964 | Hansen . | |
| 3,148,685 | 9/1964 | Haynes et al. . | |
| 3,150,393 | 9/1964 | Taylor et al. . | |
| 3,161,202 | 12/1964 | Mecca . | |
| 3,260,269 | 7/1966 | Zurndorfer . | |
| 3,275,007 | 9/1966 | Thackeray | 132/40 |
| 3,334,638 | 8/1967 | Behrens . | |
| 3,381,693 | 5/1968 | Stevens . | |
| 3,386,453 | 6/1968 | Roberts et al. . | |
| 4,145,600 | 3/1979 | Walter | 132/37 R |
| 4,161,050 | 7/1979 | Sasaki | 132/159 |
| 4,191,200 | 3/1980 | Renda . | |
| 4,211,914 | 7/1980 | Jackson | 132/37 |
| 4,215,710 | 8/1980 | Sundin . | |
| 4,314,137 | 2/1982 | Dorn . | |
| 4,326,545 | 4/1982 | Motegi | 219/225 |
| 4,327,753 | 5/1982 | Bertschi | 219/222 |
| 4,335,732 | 6/1982 | Megna . | |
| 4,368,376 | 1/1983 | Andis | 219/222 |

*Primary Examiner*—Gregory E. McNeill

*Attorney, Agent, or Firm*—Fleit, Jacobson, Cohn & Price

[57] ABSTRACT

A heated curling device with retractable combs for use in curling the hair having an arrangement for locking the comb teeth in their extended position, providing ribs on the handle for heat dissipation, a cool tip for the user and an improved inner barrel construction.

30 Claims, 15 Drawing Figures

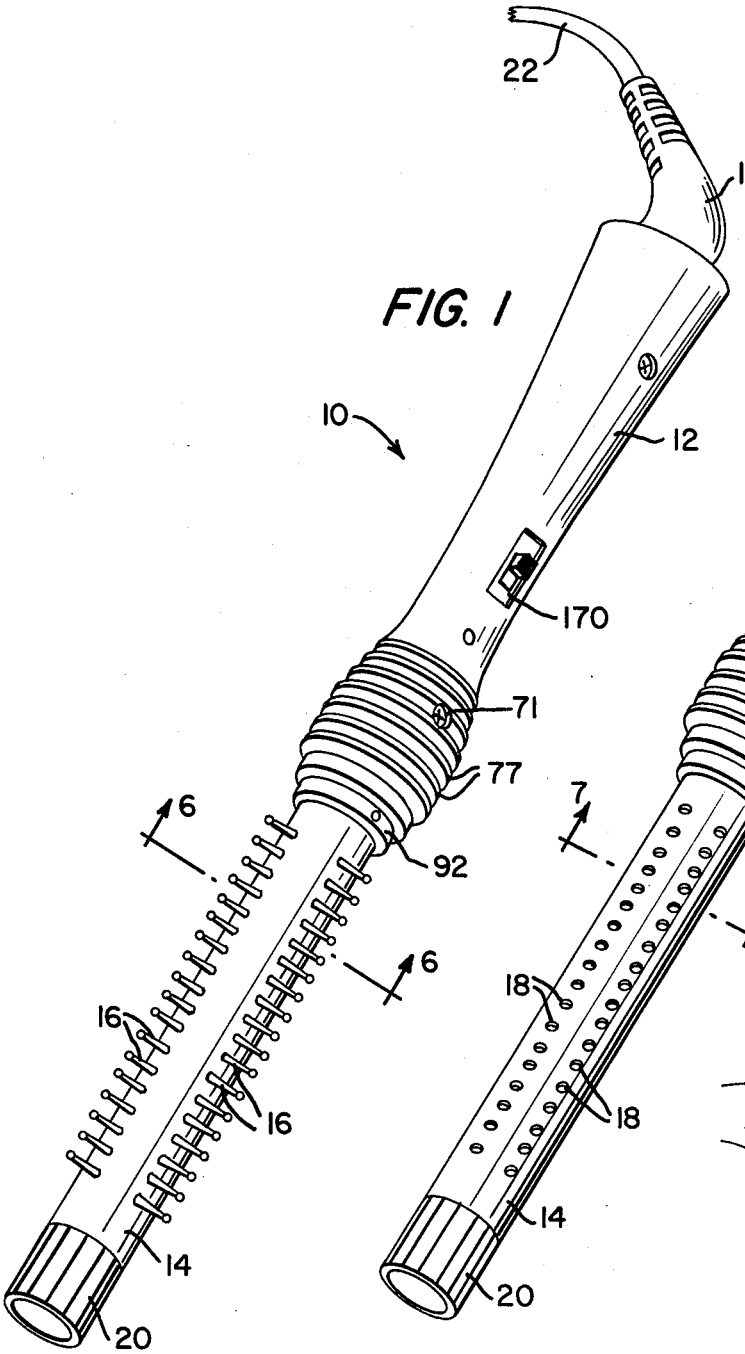
FIG. 1
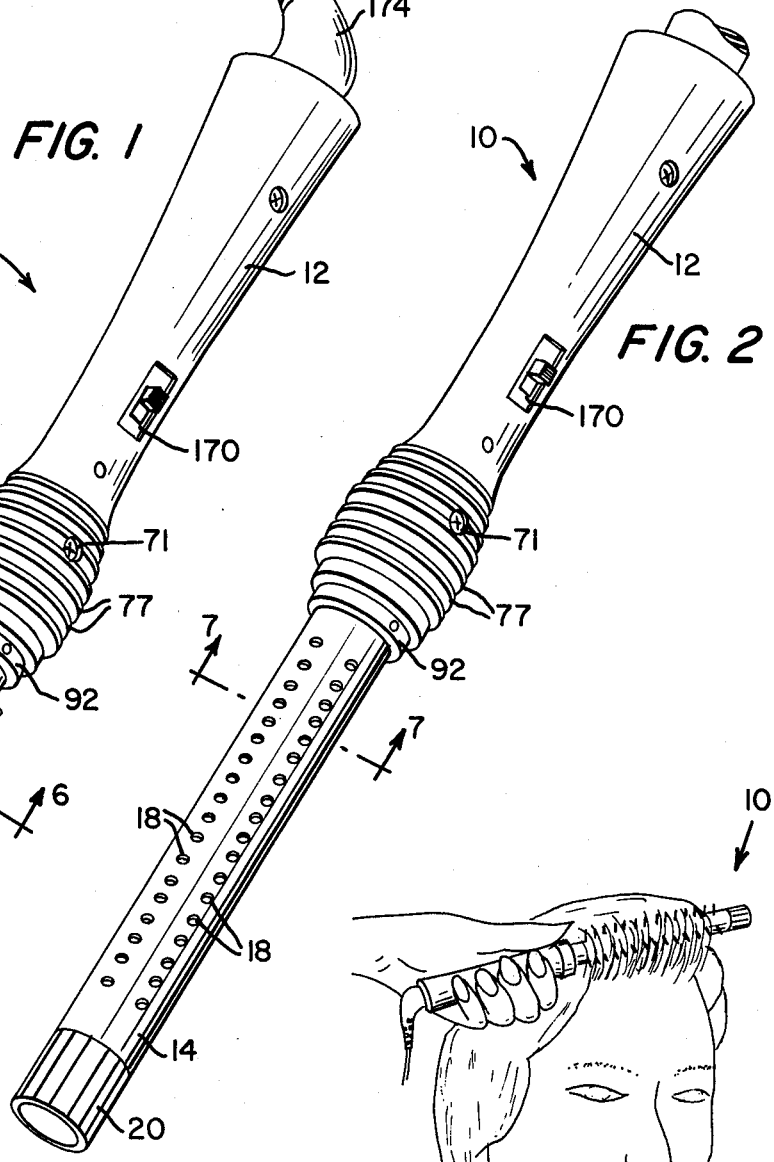
FIG. 2
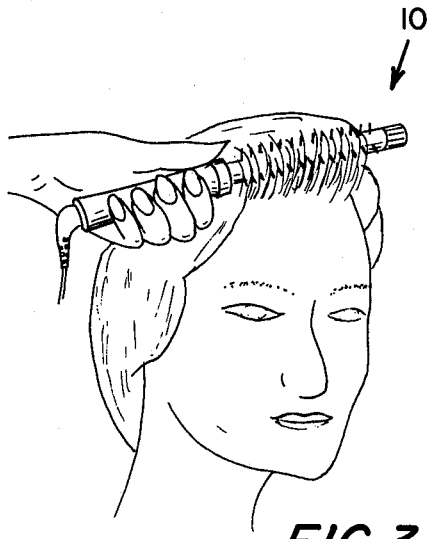
FIG. 3
FIG. 5
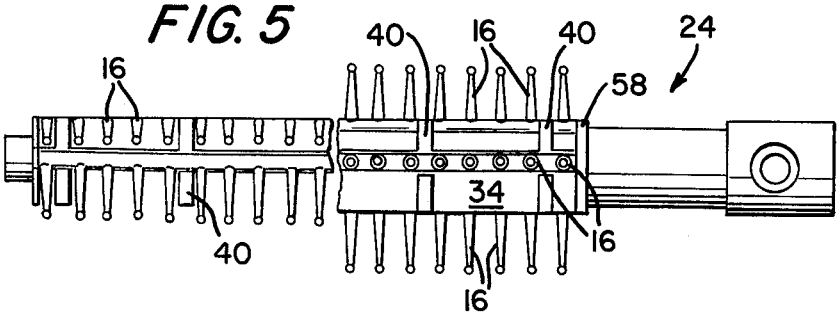

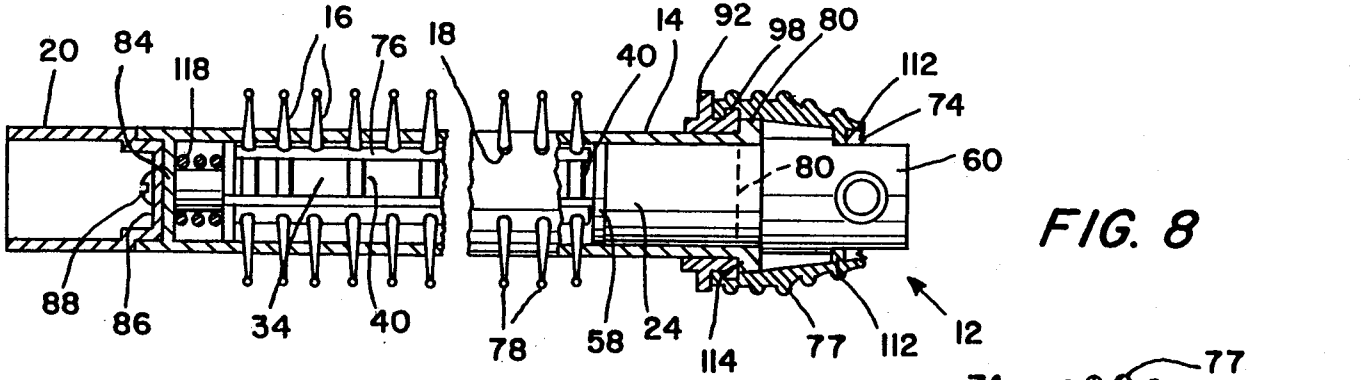
FIG. 8
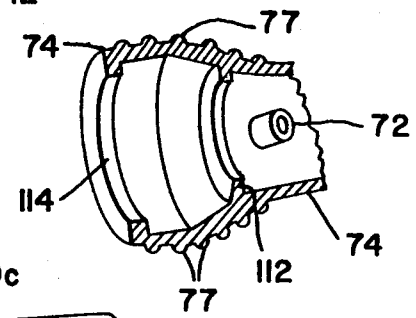
FIG. 11
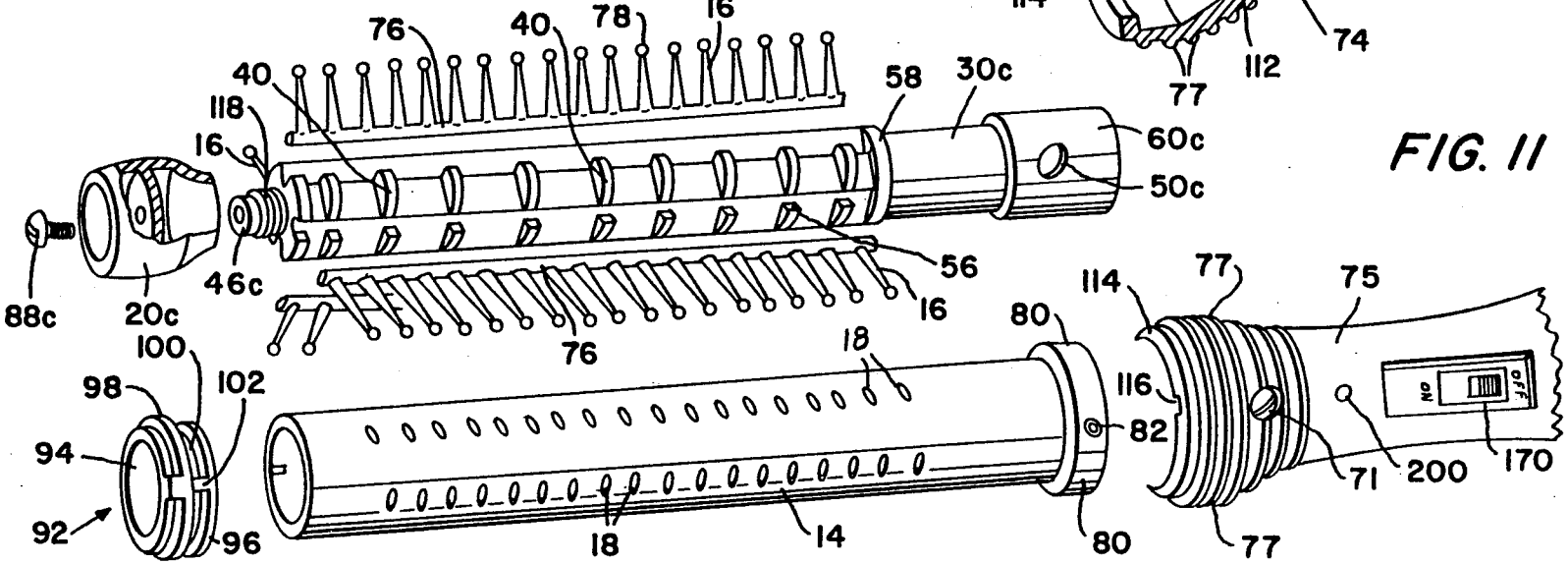

HAIR CURLING DEVICE HAVING RETRACTABLE TEETH AND LOCKING MEANS THEREFOR

CROSS-REFERENCE TO RELATED APPLICATION

This application is a continuation-in-part of copending application Ser. No. 350,185, filed Feb. 19, 1982.

BACKGROUND OF THE INVENTION

1. Field of the Invention

The present invention relates to a hair curling device having retractable teeth. More particularly, the present invention relates to a hair curling device wherein the teeth can be locked into an extended position for curling the hair and then manually retracted to permit easy withdrawal of the device from the curl and to produce a combing action during retraction of the teeth.

2. Description of the Prior Art

When treating the hair to provide a curling effect, it is desirable to provide a hair curling device having curling teeth which extend outwardly for a sufficient distance to easily curl the hair, and which will permit the lock of hair to be maintained in curled condition upon withdrawal of the device from the curled hair so that the curl is not disturbed.

Hair curling devices are described in U.S. Pat. No. 2,244,068, which issued June 3, 1941, to C. Kay, and German Offenlegungsschrift No. 2551508 to Braun. In these devices comb elements are journalled in cylindrical members so that the comb teeth can extend and retract through openings in an outer barrel.

Another device for dressing the hair is a comb having the construction described in U.S. Pat. No. 4,191,200, which issued Mar. 4, 1980, to Frank J. Renda, in which axially movable cam members and spring members are employed to project and retract the combs in a radial direction through radial openings in a tubular housing.

Still another hair curling device is shown in U.S. Pat. No. 4,327,753, which issued May 4, 1982, to Ernst Bertschi. The device there shown includes retractable curved teeth movable from an extended to a retracted position by relative rotation of an inner and outer barrel between which comb members are positioned. The Bertschi construction enables the teeth to be fully retracted within the outer barrel.

Other U.S. patents illustrating various hair dressing devices with movable teeth or brushes include: U.S. Pat. Nos. 190,602; 411,028; 2,245,055; 3,148,685; 3,260,269; and 3,381,693.

SUMMARY OF THE INVENTION

It is an object of the present invention to provide an improved hair curling device having retractable teeth which can be locked in an extended position.

It is another object of the present invention to provide a hair curling device which enables the user to wrap the hair around a barrel member having teeth extending along the length thereof, and then to remove the teeth from contact with the hair in a sweeping combing action so that the teeth are readily withdrawn from the hair and so that the barrel may then be withdrawn from the curl without disturbing it, leaving the curl intact.

It is a further object of the present invention to provide an improved hair curling device incorporating heating means to heat the hair while the curl is being formed and wherein the construction of the device is such that the combs and the barrel of the device are uniformly heated for uniform heating of the curl.

It is still another object of the present invention to provide an improved construction for a hair curling device having retractable teeth, wherein improved heat transfer is provided along the length of a tubular barrel and around the circumference thereof.

The present invention provides these and other desirable features in an improved retractable curling device which enables the user to: (a) wrap the hair around a tubular outer barrel having outwardly extending teeth which are locked in extended position; (b) apply heat to the curl; and then (c) withdraw the teeth from contact with the hair without tangling with the hair so that the barrel then can be removed from the curl without disturbing it, thus leaving the curl intact. The retraction of the teeth of the present invention is accomplished in such a way as to provide a combing action that avoids hair becoming entangled in the device.

The retractable curling brush of the present invention includes an inner barrel member within which a heating element is positioned and which has a construction to facilitate uniform heat transfer to the outer barrel. This is accomplished by a plurality of peripheral projections that extend from the inner barrel to the inside surface of the outer barrel to uniformly transfer heat along the outer barrel. The construction of the inner barrel is such that the teeth of the combs are extendable and retractable without interference. Also, in a preferred embodiment, the projections serve the double purpose of constituting part of the locking arrangement.

In one embodiment of the present invention, the teeth are movable between extended and retracted positions by the action of the outer barrel. An end cap is mounted on the outer end of the outer barrel which moves the outer barrel longitudinally with respect to the handle against a spring force to permit the teeth to be unlocked from their extended position.

In another embodiment of the present invention, the outer barrel is engaged at one end by a ring assembly which provides a means of rotating the outer barrel relative to the inner barrel to extend and retract the comb teeth against a spring force. The ring assembly is adjacent to the handle of the device and is capable of limited axial movement relative thereto and provides a locking action.

In each embodiment of the present invention, as the teeth are retracted there is a combing action of the teeth through the hair and thus tangling of the hair in the teeth or the apertures in the outer barrel is avoided.

BRIEF DESCRIPTION OF THE DRAWINGS

FIG. 1 is a perspective view of a retractable curling device in accordance with the present invention with the teeth in an extended position.

FIG. 2 is a perspective view of the curling device of FIG. 1 with the teeth in a retracted position.

FIG. 3 is a view showing the curling device of FIG. 1, with teeth extended, operatively engaged in curling hair.

FIG. 5 is a top plan view of the inner barrel of the curling device of FIG. 1 with the teeth on the inner end portion of the barrel shown in an extended position and the teeth on the outer end portion of the barrel shown in a retracted position.

FIG. 8 is a side view of the curling device shown in FIG. 4, in assembled form, and partially broken away to show the interconnection of the several elements thereof.

FIG. 11 is an exploded perspective view of still another embodiment of a retractable curling device in accordance with the present invention.

DESCRIPTION OF THE PREFERRED EMBODIMENTS

Figures 4, 10:
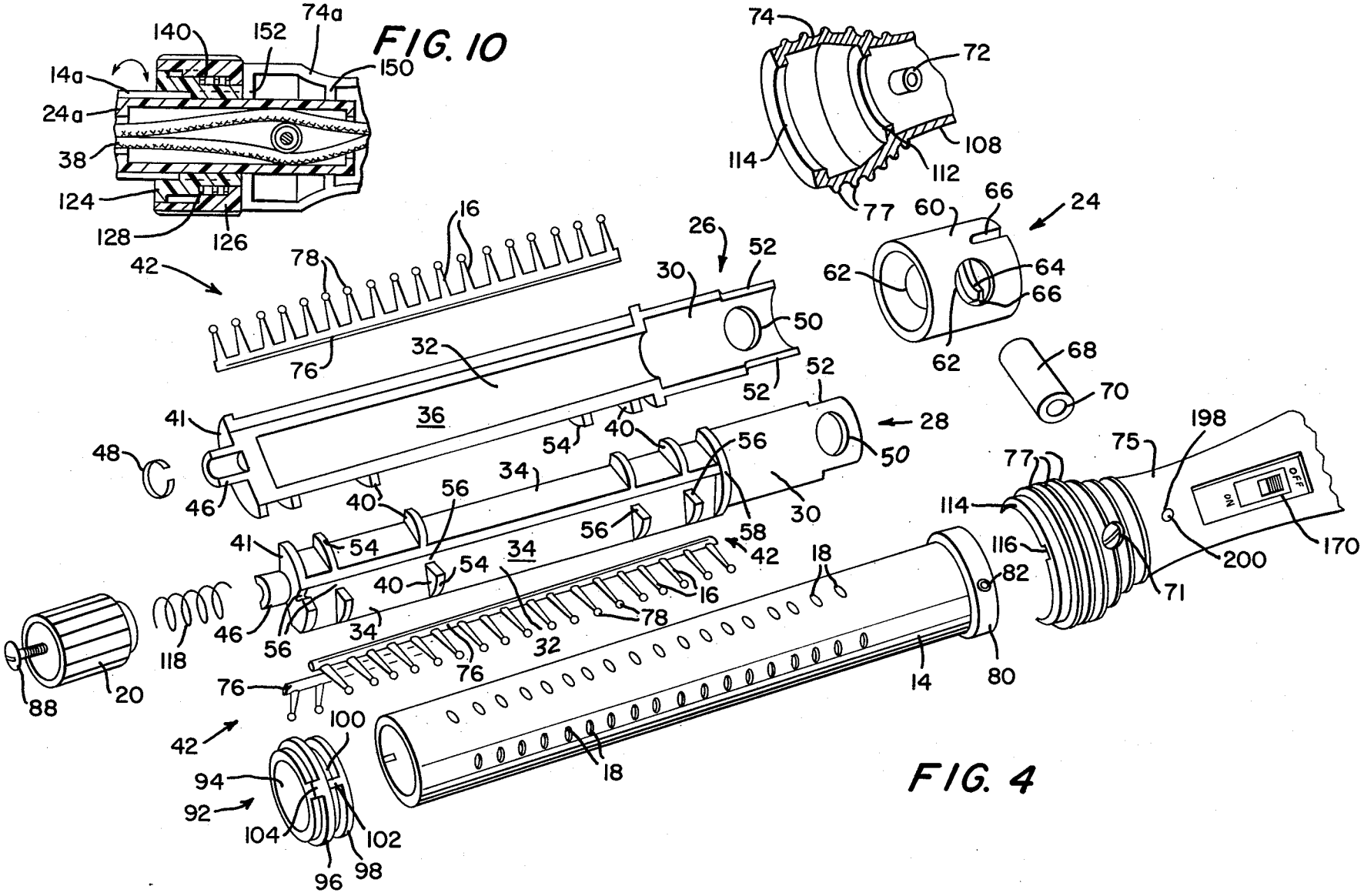
FIG. 4 is an exploded perspective view of the curling device of FIG. 1.
FIG. 10 is a cross-sectional view of the ring assembly employed in the operation of the curling device of FIG. 9.

Referring now to the drawings, in the embodiment of the invention as shown in FIGS. 1–8, there is provided a hair curling device 10 having a handle 12, a rotatable outer barrel 14, and a plurality of comb teeth 16 which extend through circumferentially spaced groups of longitudinally aligned apertures 18 in outer barrel 14. A end cap 20 is provided at the outer end of outer barrel 14 and a power cord 22 extends outwardly from handle 12. FIG. 1 shows the device with comb teeth 16 extended beyond the surface of outer barrel 14, while FIG. 2 shows the device with comb teeth 16 retracted into apertures 18. FIG. 3 shows the device in use to curl hair.

The preferred embodiment is shown in an exploded view in FIG. 4. The hair curling device includes a generally tubular inner barrel 24, which is of split construction, as shown. Each half 26, 28 of inner barrel 24 is identical, as shown, and is made from cast metal, such as aluminum, for good heat conductivity. Inner barrel 24 includes a cylindrical connecting section 30 and a comb-supporting section 32 defined by a plurality of substantially planar faces 34 terminating at one end with flanges 35 and 37. In the preferred embodiment, planar faces 34 are positioned at 90° intervals around the outer periphery of inner barrel 24. The two inner barrel sections are the same so that when put together, each flange 37 forms the termination of the associated planar surface 34 on the other barrel half. A central bore 36 extends the length of inner barrel 24 for receiving a heating element 38 (see FIGS. 6 and 7). The planar surfaces 34 of the barrel are provided with a plurality of axially spaced, transverse projections or ridges 40 to conduct heat to comb members 42 and outer barrel 14. The projections 40 extend from the free edge of each planar surface 34 and terminate spaced from the flange 35 or 37 serving as a termination at the other edge of planar surface 34. The outer edge of each projection 35, 37 is curved to fit in the outer barrel.

Each inner barrel half 26, 28 has an inner surface that defines a generally axial, semi-cylindrical recess which extends along the length of the inner barrel, so that the two inner barrel halves together define inner cylindrical bore 36 within which heating element 38 is positioned. The end of each barrel half has a substantially coaxial, semi-cylindrical extension 46. A retaining ring 48 fits around extensions 46 and holds barrel halves 26 and 28 together. Connecting section 30 includes a transverse bore 50 and opposed undercuts 52 at each outer edge thereof.

Each inner barrel half 26, 28 has on its outer surface the outwardly extending projections ridges 40 which are parallel to each other and which extend radially outwardly from planar faces 34. Each ridge 40 has a curved outer periphery 54 in the form of an arc of a circle (see FIGS. 4 and 6) to conform with the inner surface of outer barrel 14 and also defines with associated flange 35, 37 spaces 56 to receive comb member 42. The end projections 41 are similar to the intermediate projections 40 whereas the end projections 58 define the boundary between the sections 30 and 32 and defined a closed ring.

Undercuts 52 of inner barrel halves 26 and 28 define a pair of opposed, axially extending end slots. A cylindrical end cap 60 fits snugly over the end of connecting portions 30 to serve as an innermost retaining ring. End cap 60 includes a pair of opposed and aligned transverse through bores 62 that align with bores 50 in inner barrel halves 26 and 28 by means of inwardly extending index lip 64 on end cap 60. End cap 60 also includes a pair of opposed axial slots 66 that align with the slots defined by undercuts 52.

A tubular sleeve 68 fits within the throughbores 50 and 62. Handle pieces 74, 75 fit around end cap 60. Sleeve 68 includes a counterbore 70 at each end thereof to receive inwardly extending positioning bosses 72 formed on the handle pieces. Bolt 71 passes through sleeve 68 from one handle piece to the other and secures the assembly by means of a nut (not shown). Both end cap 60 and tubular sleeve 68 can be of a suitable injection molded plastic, if desired.

Comb member 42 is freely pivotally and slidably received on planar surface 34 with the back portion 76 of the comb member lying adjacent a flange 35, 37. The comb teeth 16 extend perpendicular to body portion 76. Each tooth 16 is preferably tapered and ideally is approximately $\frac{1}{4}$ to $\frac{1}{2}$ inches long and preferably about 5/16 inches long. The outer ends of the respective teeth include an enlarged, bulbous tip 78 which is preferably of spherical conformation. Comb member 42 can be formed of a heat conducting material, such as high temperature plastic, or of metal, such as aluminum, which will assist with heat transfer from the inner and outer barrels to the hair of the user.

Figures 6, 7, 9:
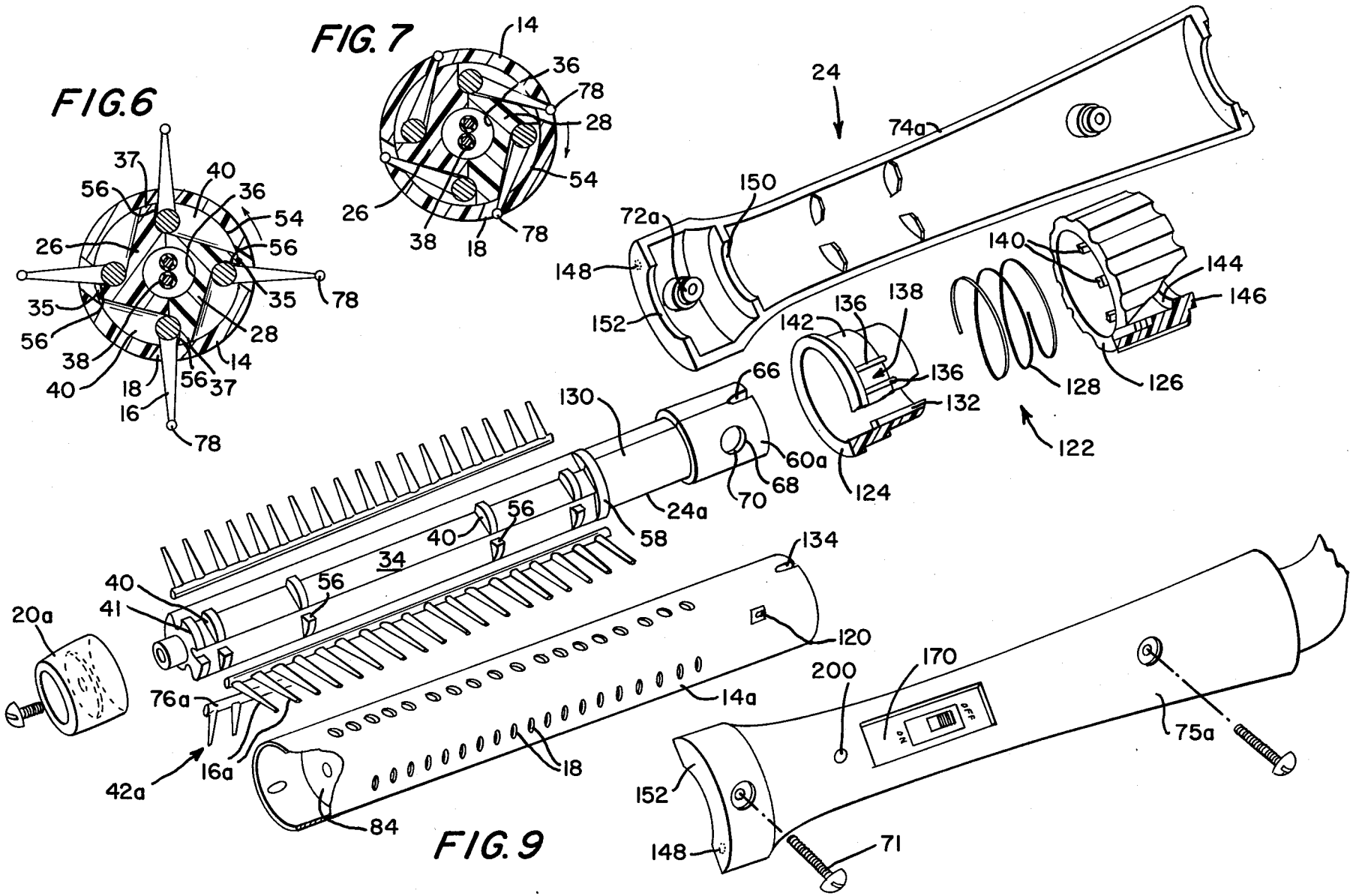
FIG. 6 is a cross-sectional view taken along line 6—6 of FIG. 1.
FIG. 7 is a cross-sectional view taken along line 7—7 of FIG. 2.
FIG. 9 is an exploded perspective view of an alternative embodiment of the curling device of the present invention.

Tubular outer barrel 14, which can be formed from aluminum or other suitable heat conductive material, is provided with a plurality of groups of longitudinally aligned apertures 18, which receive the teeth 16 that extend from respective comb members 42. Outer barrel 14 fits over and is in close engagement with projections 40 of inner barrel 24 for good heat transfer therebetween. Apertures 18 are positioned at an angle relative to the inner and outer surfaces of outer barrel 14, as shown in FIGS. 6 and 7, to permit angular inward and outward movement of teeth 16 therein. The inner diameter of outer barrel 14 is just larger than the outer diameter of inner barrel 24 to permit relative rotation and translation therebetween.

Outer barrel 14 is in the form of a one-piece tube. An annular collar 80 is secured to one end of outer barrel 14 by a suitable fastening means, such as, for example, one or more rivets 82, only one of which is visible in FIG. 4. Crimped within outer barrel 14 and spaced from but adjacent the opposite end from collar 80 is a metal disk 84 (see FIG. 8) which includes a central threaded aperture 86 to receive a screw or other fastener 88 for securing end cap 20 to outer barrel 14. The inner surface of outer barrel 14 outwardly of wall 84 includes a pair of inward ridges 90 (see FIG. 4) to engage corresponding depressions (not shown) on end cap 20 to preclude relative rotation therebetween.

The inner and outer barrels, as well as the comb members, are preferably formed from a heat conductive material, such as cast aluminum, stainless steel, ceramics, and high temperature plastics, to transfer heat from the centrally positioned heating element to the hair.

A guide sleeve 92 fits over outer barrel 14 and is a generally tubular member having a through-bore 94 corresponding in diameter with the outer diameter of outer barrel 14 in order to slidably support the same. The outer surface of guide sleeve 92 includes a pair of spaced, outwardly extending circumferential ridges 96, 98 to define an annular groove 100 therebetween, which includes a positioning projection 102. Also provided on the outer surface of guide sleeve 92 is an orientation projection 104 in order to properly orient the sleeve to facilitate assembly to the handle.

As shown in FIG. 4, the hair curling device 10 includes a two-piece hollow handle wherein the inner surface of each of the respective handle halves 74, 75 includes a positioning boss 72 (only one of which is visible in FIG. 4) located inwardly of an inwardly extending, transverse supporting rib 112. The inner end of each of handle halves 74, 75 includes an inwardly extending lip 114 spaced outwardly from rib 112, the two lips 114 together defining a circular opening to receive guide sleeve 92. Handle half 75 includes a radial notch 116 in lip 114 to permit positioning of guide sleeve 92 in non-rotatable engagement with the handle. Each of the handle halves includes a plurality of circumferential ribs 77 adjacent the outer barrel to assist in dissipating heat.

The embodiment of FIG. 4 assembled is shown in FIG. 8. Assembly is accomplished by securing inner barrel halves 26, 28 together by means of retaining ring 48 and end cap 60, sliding heating element 38 into inner barrel 24 and inserting tubular sleeve 68 into through-bores 50, 62. The respective comb members 42 are first placed within outer barrel 14 so that teeth 16 extend radially outwardly through apertures 18, whereupon inner barrel 24 with spring 118 mounted on extension 46, is axially slidably inserted within outer barrel 14. The spaces 56 of inner barrel 24 enable the inner barrel to be inserted without conflict with body portions 76 of comb members 42. The outer end of inner barrel 24 is biased away from disk 84 of outer barrel 14 by spring 118. End cap 20, made of plastic to remain cool, is secured to outer barrel 14 by means of bolt 88 and guide sleeve 92 is then slipped over outer barrel 14 and against collar 80.

The barrel assembly is then positioned in handle members 74, 75 so that connecting portion 30 of inner barrel 24 is between inner supporting ribs 112, and so that inwardly extending lips 114 are received in annular groove 100 of guide sleeve 92 with positioning projection 102 on guide sleeve 92 engaging notch 116 provided on handle member 75. Thereafter, connecting screw 71 is is inserted and secured to provide as assembled handle member.

In connection with the operation of the device, it can be seen in FIG. 8 that outer barrel 14 is capable of limited axial movement within handle 12 between ridge 98 of guide sleeve 92 and cylindrical end cap 60 of inner barrel 24. As outer barrel 14 moves from its innermost position (toward the handle) to its outermost position (away from the handle), which is shown in full lines in FIG. 8, it simultaneously carries with it the respective comb members 42, the body portions 76 of which slide axially (along planar surfaces 34 against flanges 35, 37. Spaces 56 allow this axial slide. Spring 118 normally biases outer sleeve 18 to its outermost position. The axial length of body portions 76 of comb members 42 is shorter than the axial extent of the comb supporting portion of inner barrel 24. When comb members 42 are shifted axially with outer barrel 14 to the outermost position certain teeth 16 align with projections 40 rendering the outer barrel 14 substantially nonrotatable. This occurs when teeth 16 are extended radially outwardly to their maximum extension, and hence the teeth are locked extended until the user applies an axial force against end cap 20 forcing outer barrel 14 to its innermost position against the bias of spring 118. At the innermost position of barrel 14, there is no conflict between the teeth 16 and projections 40.

In the retracted position, the outer ends of the teeth 16 remain either slightly projecting or within the apertures as shown in FIG. 7, but the teeth 16 are not completely withdrawn interiorly of the outer barrel 14.

The angle of apertures 18 relative to the inner and outer surfaces of the outer barrel 14 will result in the walls of apertures 18 providing additional support for the teeth 16 in the extended position, while also assisting in retaining the teeth when in the retracted position. Generally, the walls of apertures 18 are at an angle of about 45° with a tangent to the outer surface of outer barrel 14. Thus, in the extended tooth position, each tooth 16 will be supported on one side by the point of intersection of the wall of aperture 18 and the inner surface of outer barrel 14, and on the opposite side the tooth will be supported by the point of intersection of the wall of aperture 18 and the outer surface of outer barrel 14, as shown in FIG. 6. In one embodiment, the outer barrel 14 had a wall thickness of approximately 3/32"; the apertures 18 had a diameter of approximately $\frac{1}{8}$"; the diameter of each tooth 16 at its base was approximately 3/32"; the length of each tooth 16 was approximately 5/16"; and the outer diameter of outer barrel 14 was approximately $\frac{3}{4}$".

A second embodiment of the present invention is shown in FIGS. 9 and 10 wherein generally similar handle, inner barrel, and comb members are provided. Like parts have been give the same reference numbers. Outer barrel **14*a* is generally similar to the embodiment shown in FIG. 4 but it does not include the annular collar. Instead, barrel 14*a* includes tabs 120 formed 180° apart adjacent the innermost ridge 58 of inner barrel 24*a*. Tabs 120 are bent inwardly after insertion of the inner barrel and abut ridge 58 to confine inner barrel 24*a* between tabs 120 and transverse wall 84** and thereby preclude relative axial movement of the inner barrel and the outer barrel.

Tne mechanism for operating teeth 16 between the extended position shown in FIG. 6 and the retracted position shown in FIG. 7 is provided in this embodiment by a ring assembly 122 which includes an inner ring 124 and an outer ring 126, together with a spring 128, as shown in FIGS. 9 and 10. Inner ring 124 is of a size which allows it to fit tightly over the inner end portion of outer barrel 14*a* and overlies an indented portion 130 of inner barrel 24*a*. A lug 132 located on the interior surface of inner ring 124 engages slot 134 in outer barrel 14*a* so that inner ring 124 and outer barrel 14*a* are rotatable as a unit. Two pairs of raised tabs 136 are positioned 180° apart on the exterior of inner ring 124, to define a pair of opposed slots 138, only one of which is visible in FIG. 9. Slots 138 are adapted to receive corresponding lugs 140 on the interior of outer ring 126 when the same is moved forward toward outer barrel 14*a*. A shoulder 142 on the inner end of inner ring 124, and a shoulder 144 on outer ring 126 serve to define abutments for spring 128, with outer ring 126 fitting over spring 128 so that lugs 140 are spaced axially from slots 138 on the exterior of inner ring 124.

Spring 128 biases outer ring 126 away from outer barrel 14*a* into a position where it cannot rotate inner ring 124. By moving outer ring 126 toward outer barrel 14*a* against the force of spring 128, lugs 140 of outer ring 126 engage slots 138 of inner ring 124 so that rotation of outer ring 126 will also rotate inner ring 124 which, in turn, will rotate outer barrel 14*a* (see FIG. 10). Rotation of outer barrel 14*a* causes pivoting of the comb members and the corresponding extension or retraction of the teeth as is shown in FIGS. 6 and 7.

Outer ring 126 is provided with a pair of lugs 146 spaced 180° apart and extending toward handle 24. Lugs 146 engage corresponding recesses 148 in handle members 74*a*, 75*a* adjacent ring assembly 122 to prevent relative rotation between the handle and the outer barrel. Forcing outer ring 126 in a direction away from the handle toward outer barrel 14*a* unlocks outer ring 126 from handle members 74*a* and 75*a* and engages inner ring 124, whereupon rotation of outer ring 126 causes outer barrel 14*a* to rotate and thereby extend or retract comb teeth 16. Continued rotation of the outer ring will cause lugs 146 to once again cause lugs 146 to engage corresponding recesses 148 in handle members 74*a*, 75*a*, and depending upon the direction of rotation teeth 16 will be locked either in the extended or in the retracted position.

Other structural differences between the embodiment shown in FIGS. 9 and 10 and that shown in FIGS. 1–8 are that the supporting bosses 72 are positioned between the inner and outer supporting ridges 150, 152, rather than inwardly of inner ridges 150. Additionally, comb members 42*a* are metallic and have tapered teeth 16*a* with rounded, non-bulbous ends. Also end cap 20*a* serves only as a cool tip.

Figures 12, 14:
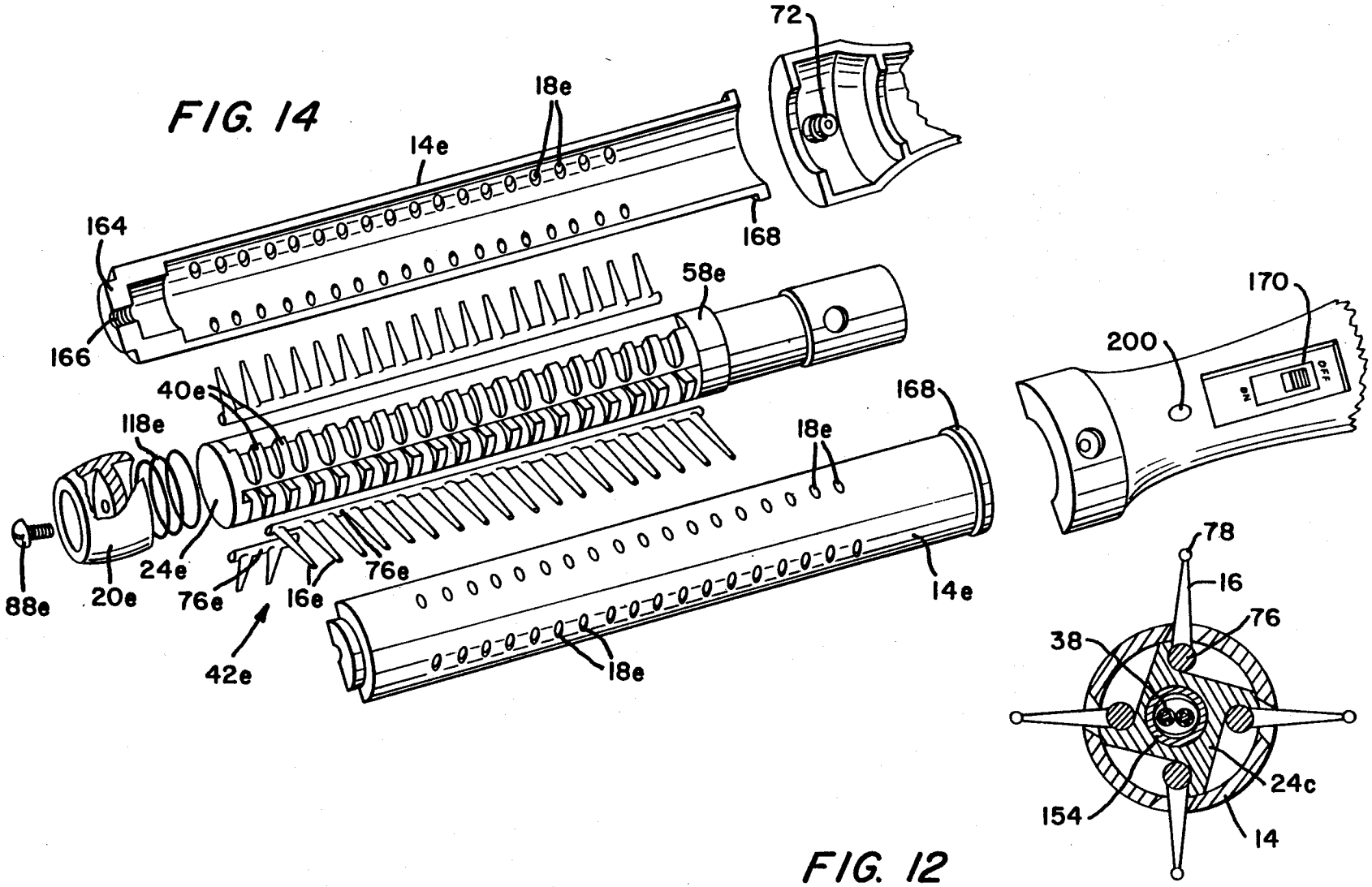
FIG. 12 is a transverse cross-sectional view through the barrel of the curling device of FIG. 11.
FIG. 14 is an exploded perspective view of a further embodiment of the invention.

In the embodiment illustrated in FIGS. 11 and 12, like parts have been given the same reference numbers. In this embodiment inner barrel 24*c* is of one-piece, molded plastic construction and includes a larger number of transverse projections 40, the number being dependent upon the heat transfer characteristics of the material from which the barrel is made. A barrel made from a material having a high thermal conductivity, such as metal, does not require as many as one made from a material having a lower thermal conductivity, such as plastic.

At its inner end relative to the handle, inner barrel 24*c* includes an integral enlarged cylindrical end 60*c* having a counterbored through bore 50*c* which is received in supporting bosses 72 in handle pieces 74 and 75.

As seen most clearly in FIG. 12, inner barrel 24*c*, which is formed from high temperature plastic, includes a central through-bore 36*c* within which a metallic inner sleeve 154 is provided in closely fitting relationship. Inner sleeve 154 is hollow to permit the positioning therewithin of heating element 38, the structure of which will hereinafter be described. The purpose of metallic sleeve 154 is to uniformly distribute along inner barrel 24*c* the heat which is given off by heating element 38.

Figure 13:
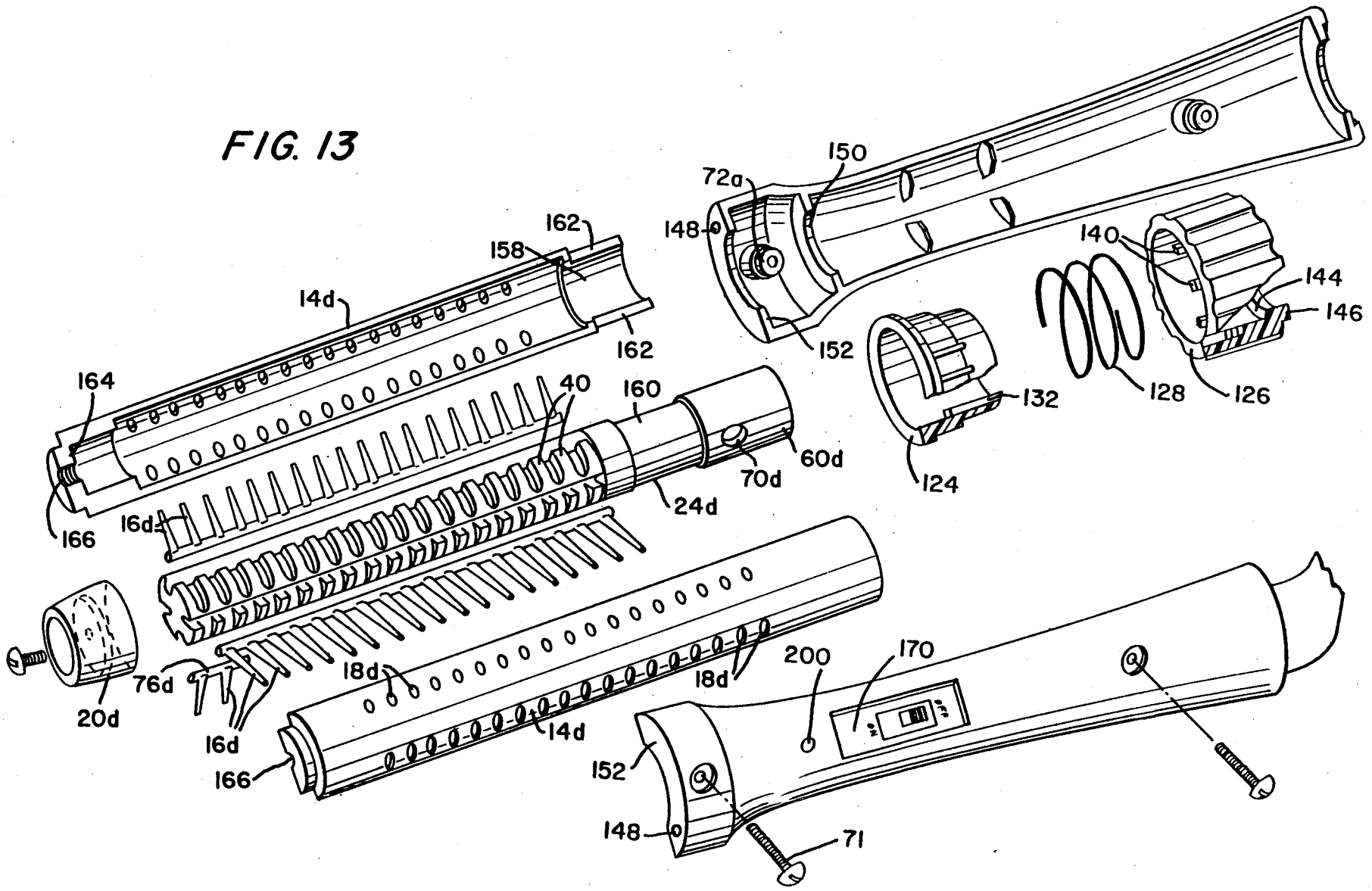
FIG. 13 is an exploded perspective view of another embodiment including an alternative form of an outer barrel and an alternative form of an inner barrel which can be incorporated in a retractable curling device in accordance with the present invention.

Another embodiment of the invention is shown in FIG. 13. The basic structure and operation of the hair curling device there shown is the same as the embodiment of FIGS. 9 and 10 and the same reference numerals identify the same elements. The principal differences reside in the construction of inner barrel 24*d* and outer barrel 14*d*. Outer barrel 14*d* is of split construction and at its innermost end relative to the handle it includes a reduced inner diameter end 158, which engages a correspondingly shaped peripheral recess 160 in inner barrel 24*d* to position the barrels in rotational but non-translational relationship. End 158 and recess 160 of this embodiment perform the same function as tabs 120 and ridge 58 of the FIG. 9 embodiment.

Outer barrel 14*d* also includes axial recesses 162 at the inner ends to define a pair of opposed axial slots when the two halves are assembled. The slots receive lug 132 of inner ring 124. At the outer end of outer barrel 14*d*, an integral transverse wall 164 is provided which includes a threaded aperture 166 to receive a screw by means of which end cap 20*d* is secured thereto.

Inner barrel 24*d* of the FIG. 13 embodiment is of single piece construction and includes the maximum number of transverse ridges 40 whereby each tooth when in the extended position is opposite to and is locked in position by a projection 40. The additional projections 40 also provide improved heat transfer from inner barrel 24*d* to outer barrel 14*d*.

A further embodiment of the invention is shown in FIG. 14, which is similar structurally and identical operationally to the embodiment of FIG. 4, except for the structure of inner barrel 24*e* and outer barrel 14*e*, and the same reference numerals identify the same elements. In this embodiment inner barrel 24*e* is of single piece construction as in the FIG. 13 embodiment, and outer barrel 14*e* is also structurally similar to that of the FIG. 13 embodiment except that it does not include the reduced inner diameter end but, instead, includes an integral, outwardly extending flange 168 which performs the same function as collar 80 of the FIG. 4 embodiment.

The heating element 38 is of the same structure for each of the disclosed embodiments and is a rope heating element, which extends along the length of central bore 36 within inner barrel 24. Heating element 38 is connected to a conventional control switch 170 suitably mounted within handle 24, and is connected to an electrical conduit 172 for connection to a source of electric power (not shown). Switch 170 can be a two position switch having ON and OFF positions, as shown, or it can be a three position switch (not shown) having LOW heat, HIGH heat, and OFF positions, if desired. Heating element 38 is generally about $\frac{1}{8}$ to $\frac{1}{4}$ inch in diameter, and it should be capable of providing heat uniformly along its operative length. As an alternative heating element, a solid state device in the form of a positive temperature coefficient (PTC) heater (not shown) can be employed.

Figure 15:
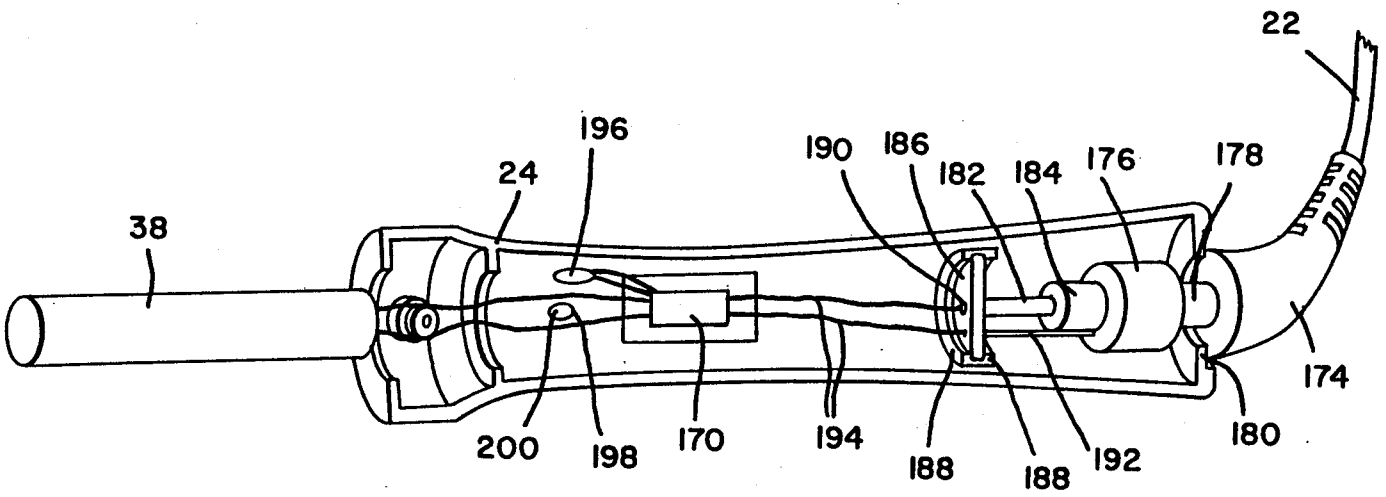
FIG. 15 is a perspective view of one of the handle halves showing the electrical interconnection arrangement for the heating element.

The connection between the heating element and the source of electric power is illustrated in FIG. 15. As there shown, a line cord 22 extends from a plug (not shown) adapted for connection to a wall outlet (not shown) to a connector 174 which is rotatably mounted in handle 24 to permit it to swivel as the device is handled or turned during use to thereby avoid tangling of line cord 22. Connector 174 includes a tubular projection 176 having a peripheral recess 178 adapted to be received in a pair of corresponding inwardly directed flanges 180 on the outer end of handle 24. A center terminal 182 and a coaxial outer terminal 184 are provided to engage a terminal board 186 positioned in slots 188 provided in each of the handle members. Terminal board 186 includes an inner terminal 190 engageable with center terminal 182 of the connector and an outer terminal 192 engageable with outer terminal 184. The arrangement provides continuous contact between connector 174 and terminal board 186 regardless of the rotational position of connector 174. Suitable conductors 194 extend from terminal board 186 to heating element 38 through the manually operable slide switch 170. If desired, an indicator lamp 196 can be provided and connected so that it lights when power is supplied to the heating element. Indicator lamp 196 is positioned adjacent an aperture 198 in which a transparent or translucent lens 200 is positioned to permit a visual determination to be made that power is being supplied to the heating element.

The present invention may be embodied in other specific forms without departing from the spirit or essential characteristics thereof. The disclosed embodiments are presented merely as illustrative thereof, and not restrictive, with the scope of the invention being indicated by the attached claims rather than foregoing description. All changes which come within the meaning and range of equivalency of the claims are therefore intended to be embraced therein.

What is claimed is:

1. A hair curling device comprising:

(a) a handle;

(b) an elongated hollow outer barrel extending for said handle and including a plurality of aligned apertures;

(c) an inner barrel extending from said handle, said inner and outer barrels being coaxial and rotatably and axially slidably movable relative to each other;

(d) biasing means urging said outer barrel outwardly relative to said handle to a locking position;

(e) a plurality of comb members positioned between said inner barrel and said outer barrel and including teeth projecting through and movable within said apertures;

(f) moving means for moving said teeth from an outwardly extended, combing position to a retracted position with said teeth slightly projecting from said apertures; and (g) means defined by the inner barrel cooperating with said comb members for locking said teeth in said outwardly extending position, the extension of the teeth enabling the biasing means to slide the outer barrel to the locking position.

2. The hair curling device of claim 1 including biasing means to axially bias said inner barrel and said outer barrel to a predetermined relative position.

3. The hair curling device of claim 1 wherein said moving means comprises means for relatively rotating said outer barrel member and said inner barrel member to move said teeth within said apertures.

4. A hair curling device comprising:

(a) a handle;

(b) an elongated hollow outer barrel extending from said handle and including a plurality of aligned apertures;

(c) an inner barrel rotatably positioned within said outer barrel;

(d) a plurality of comb members positioned on said inner barrel and including teeth projecting through and movable within said apertures of said outer barrel;

(e) moving means for moving said teeth from an outwardly extended combing position to a retracted position with said teeth slightly projecting from said apertures, said moving means including means for relatively rotating said outer barrel member and said inner barrel member to move said teeth between said positions, said rotating means comprising a ring assembly carried by said outer barrel member, said ring assembly including an inner ring mounted on said outer barrel for enabling rotation of said outer barrel with said inner ring, an outer ring mounted concentrically with the inner ring, said outer ring being movable between a locked and unlocked position, biasing means positioned between said inner and outer rings for biasing said outer ring into a locked position, said outer ring being axially movable for unlocking the same and being rotatable when unlocked, and means for causing said inner ring to rotate with said outer ring when said outer ring is unlocked, the rotation of said inner ring causing rotation of said outer barrel member; and (f) means cooperating with said comb members for locking said teeth in said outwardly extended position.

5. The hair curling device of claim 3 wherein said rotating means comprises: means for moving the outer barrel member relative to the inner barrel member along the longitudinal axis of the curling device; and means for biasing the outer barrel member with respect to the inner barrel for biasing said outer barrel member into a locked, non-rotating position; and means for unlocking said outer barrel member by movement of said outer barrel member along the longitudinal axis of the curling brush and enabling said outer barrel member to be rotated for causing said teeth to move from a retracted position to an extended position substantially perpendicular to the outer barrel with a portion of each tooth occupying one of said apertures.

6. The hair curling device of claim 1 wherein each comb member includes a longitudinally extending body portion and a plurality of teeth extending substantially perpendicularly from said body portion.

7. The hair curling device of claim 1 wherein the apertures in said outer barrel member are formed with the side walls thereof inclined at an angle of about 45° with respect to a tangent to the outer surface of said outer barrel.

8. The hair curling device of claim 7 wherein said teeth in extended position are supported by the points of intersection of the walls of said apertures and the inner and outer surfaces of said outer barrel member.

9. The hair curling device of claim 8 wherein, when said teeth are in their retracted position, the walls of said apertures are substantially parallel to planar faces along which the teeth lie in said retracted position.

10. The hair curling device of claim 1 wherein the inner and outer barrel members and the comb members are formed of a material capable of readily transferring heat, such as aluminum, stainless steel, ceramics and high temperature plastics.

11. A retractable hair curling device comprising: an elongated inner barrel member of generally rectangular cross-section including planar surfaces terminating at one end in flanges, said planar surfaces having a plurality of arcuate, transversely extending ridges positioned in spaced relationship therealong and defining a plurality of longitudinally aligned spaces along said inner barrel member; a handle secured to one end of the inner barrel member; at least one toothed comb member pivotally supported by said inner barrel member and carried in said longitudinally aligned spaces; an outer barrel member rotatably and axially slidably mounted around said inner barrel member, said outer barrel member having a plurality of axially aligned apertures for receiving the teeth of said comb members; and means for rotating said outer barrel member relative to said inner barrel member so that the teeth of said comb members move between an extended, combing position in which each tooth is extended substantially perpendicularly to the exterior of said outer barrel to a retracted position with said teeth slightly projecting from said apertures and with said teeth being pivoted as they are retracted for providing a combing action of said teeth through the hair; and means for locking said inner and outer barrels to prevent relative rotation therebetween.

12. The hair curling device of claim 11 further comprising heating means positioned within said inner barrel for providing heat to the device.

13. A retractable hair curling device comprising: an inner barrel member having a plurality of transversely extending ridges positioned in spaced relationship along the peripheral surface of said inner barrel member; a handle secured to one end of the inner barrel member; a toothed comb member pivotally supported by said inner barrel member; an outer barrel member rotatably mounted around said inner barrel member, said outer barrel member having a plurality of apertures for receiving the teeth of said comb members; and means for rotating said outer barrel member relative to said inner barrel member so that the teeth of said comb members move between an extended, combing position in which each tooth is extended substantially perpendicularly to the exterior of said outer barrel to a retracted position with said teeth slightly projecting from said apertures and being pivoted as they are retracted for providing a combing action of said teeth through the hair, said means for rotating said outer barrel member comprising a ring assembly carried by said outer barrel member, said ring assembly including: an inner ring mounted on said outer barrel for enabling rotation of said outer barrel with said inner ring; an outer ring mounted concentrically with said inner ring, said outer ring movable between a locked and an unlocked position; biasing means positioned between said inner and outer rings for biasing said outer ring into a locked position; said outer ring being axially movable for unlocking said outer ring and said outer ring being rotatable when unlocked; and means for causing said inner ring to rotate with said outer ring when said outer ring is unlocked and rotated, the rotation of said inner ring causing rotation of said outer barrel member.

14. The hair curling device of claim 11 wherein said means for rotating said outer barrel member comprises: means for moving the outer barrel member along the longitudinal axis of the device; means for biasing the outer barrel member with respect to the inner barrel for biasing said outer barrel member into a locked, non-rotating position when said teeth are fully extended through said apertures; and means for unlocking said outer barrel member by axial movement of said outer barrel member and said comb members relative to said inner barrel to enable said outer barrel member to be rotated for causing said teeth to move from an extended position substantially perpendicular to the outer barrel to a retracted position with said teeth slightly projecting from said apertures.

15. The hair curling device of claim 11 wherein each comb member includes a longitudinally extending body portion and a plurality of aligned teeth extending substantially perpendicularly from said body portion.

16. The hair curling device of claim 11 wherein said ridges are substantially perpendicular to the longitudinal axis of said inner barrel member.

17. The hair curling device of claim 11 wherein said comb members are positioned at 90° intervals around the circumference of the inner barrel.

18. The hair curling device of claim 11 wherein the apertures in said outer barrel member are formed with the side walls thereof inclined at an angle of about 45° with respect to a tangent to the outer surface of said outer barrel member.

19. The hair curling device of claim 11 wherein when said teeth are in their retracted position, the walls of said apertures are substantially parallel to the planar faces adjacent to which each tooth lies when in said retracted position.

20. The hair curling device of claim 11 wherein said inner and outer barrel members and said comb members are formed from heat conductive material.

21. The hair curling device of claim 11 wherein said inner barrel is non-metallic and includes a metallic inner sleeve.

22. The hair curling device of claim 12 wherein the outer barrel has mounted at its end a tip having a low coefficient of heat transfer to remain cool during use.

23. The hair curling device of claim 12 wherein the handle is provided with a series of cooling ribs adjacent the interconnection with the outer barrel.

24. The hair curling device of claim 1 wherein said outer barrel includes an outwardly extending flange at one end thereof, said flange defined by an annular collar secured to said outer barrel and rotatably received in said handle to permit relative rotation between said outer barrel and said handle.

25. The hair curling device of claim 24 wherein said outer barrel includes a transverse wall spaced inwardly of and adjacent to the other end thereof, said transverse wall including means to receive a fastening device.

26. The hair curling device of claim 1 wherein each of said teeth includes a bulbous, rounded tip.

27. The hair curling device of claim 24 wherein said tips are substantially spherical.

28. The hair curling device of claim 1 including a guide sleeve slidably surrounding said outer barrel and carried by said handle to rotatably and slidably support said outer barrel.

29. The hair curling device of claim 1 wherein said locking means includes a plurality of transverse arcuate ridges extending radially from said inner barrel and having longitudinally aligned spaces to pivotally and slidably receive said comb members, said spaced, arcuate ridges defining transverse, intermediate, tooth-receiving spaces, said comb teeth being partially received in said transverse intermediate spaces when said teeth are in retracted position with said teeth slightly projecting from said apertures, and said comb teeth being locked in extended, combing position by axially shifting the comb members relative to said inner barrel so that certain comb teeth lie in said longitudinally aligned spaces and are opposite said ridges, whereby relative rotation between said inner barrel and said outer barrel is prevented.

30. The hair curling device of claim 11 wherein said locking means includes a plurality of transverse arcuate ridges extending radially from said inner barrel and having longitudinally aligned spaces to pivotally and slidably receive said comb members, said spaced, arcuate ridges defining transverse, intermediate, tooth-receiving spaces, said comb teeth being partially received in said transverse intermediate spaces when said teeth are in retracted position with said teeth slightly projecting from said apertures, and said comb teeth being locked in extended, combing position by axially shifting the comb members relative to said inner barrel so that certain comb teeth lie in said longitudinally aligned spaces and are opposite said ridges, whereby relative rotation between said inner barrel and said outer barrel is prevented.

* * * * *